US009543628B2

(12) United States Patent
Lee et al.

(10) Patent No.: US 9,543,628 B2
(45) Date of Patent: Jan. 10, 2017

(54) FOLDED CORRUGATED SUBSTRATE INTEGRATED WAVEGUIDE

(71) Applicant: AJOU UNIVERSITY INDUSTRY COOPERATION FOUNDATION, Gyeonggi-do (KR)

(72) Inventors: Hai Young Lee, Seongnam-si (KR); Dae Keun Cho, Suwon-si (KR); Jin do Byun, Anyang-si (KR)

(73) Assignee: AJOU UNIVERSITY INDUSTRY-ACADEMIC COOPERATION FOUNDATION, Suwon-si (KR)

( * ) Notice: Subject to any disclaimer, the term of this patent is extended or adjusted under 35 U.S.C. 154(b) by 0 days.

(21) Appl. No.: 14/649,089

(22) PCT Filed: Nov. 29, 2013

(86) PCT No.: PCT/KR2013/010972

§ 371 (c)(1),
(2) Date: Jun. 2, 2015

(87) PCT Pub. No.: WO2014/157809

PCT Pub. Date: Oct. 2, 2014

(65) Prior Publication Data

US 2015/0318598 A1 Nov. 5, 2015

(30) Foreign Application Priority Data

Mar. 25, 2013 (KR) ..... 10-2013-0031457

(51) Int. Cl.
*H01P 3/12* (2006.01)
*H01P 3/16* (2006.01)
*H01P 3/123* (2006.01)

(52) U.S. Cl.
CPC ..... *H01P 3/121* (2013.01); *H01P 3/122* (2013.01); *H01P 3/123* (2013.01); *H01P 3/16* (2013.01)

(58) Field of Classification Search
CPC ..... H01P 3/122; H01P 3/123; H01P 3/16; H01P 5/18; H01P 5/10; H01P 1/182; H01P 3/121

(Continued)

(56) References Cited

U.S. PATENT DOCUMENTS 6,927,653 B2 * 8/2005 Uchimura ..... H01P 1/2088 333/113
2004/0251992 A1 * 12/2004 Kim ..... H01P 3/122 333/208

(Continued)

FOREIGN PATENT DOCUMENTS

KR 10-2011-0058936 A 6/2011
KR 10-2011-0076517 A 7/2011
KR 10-1090857 B1 12/2011

OTHER PUBLICATIONS

Denis G. Chen et al., "Substrate Integrated Waveguide with Corrugated Wall", in Proc. Asia-Pacific Microwave Conference, 2008.

(Continued)

*Primary Examiner* — Benny Lee
*Assistant Examiner* — Jorge Salazar, Jr.
(74) *Attorney, Agent, or Firm* — Stein IP, LLC

(57) ABSTRACT

A folded corrugated substrate integrated waveguide is disclosed. The folded corrugated substrate integrated waveguide, according to one embodiment of the present invention, comprises: a first conductor plate having upper surface stubs respectively formed on both sides thereof in the lengthwise direction; a first dielectric substrate of which the upper surface is attached to the lower surface of the first conductor plate; a second conductor plate of which the upper surface is attached to the lower surface of the first dielectric substrate; a second dielectric substrate of which the upper surface is attached to the lower surface of the second conductor plate; and two stub conductor arrays spaced at a certain distance so as to be arranged in parallel to each other and attached to the lower surface of the second dielectric substrate, wherein each of the stub conductors in the two stub conductor arrays is electrically connected to a position corresponding to the upper surface stub of the first conductor (Continued)

plate through a via-hole which vertically penetrates the first dielectric substrate, the second conductor plate, and the second dielectric substrate.

5 Claims, 7 Drawing Sheets

(58) Field of Classification Search
USPC .... 333/25, 26, 113, 137, 157, 208, 239, 248
See application file for complete search history.

(56) References Cited

U.S. PATENT DOCUMENTS

| | | | | |
|---|---|---|---|---|
| 2009/0066597 | A1 | 3/2009 | Yang et al. | 343/771 |
| 2009/0243762 | A1 | 10/2009 | Chen et al. | 333/212 |
| 2012/0280770 | A1 | 11/2012 | Abhari et al. | 333/209 |

OTHER PUBLICATIONS

Lin-Sheng Wu et al., "A New Type of Periodically Loaded Half-Mode Substrate Integrated Waveguide and Its Applications", IEE Transactions on Microwave Theory and Techniques, vol. 58, No. 4, Apr. 2010.

Kimberley W. Eccleston, "Mode Analysis of the Corrugated Substrate Integrated Waveguide", IEE Transactions on Microwave Theory and Techniques, vol. 60, No. 10, Oct. 2012.

Hai Young Lee et al., "Folded Corrugated SIW Slot Antenna with Back-lobes Suppression", Nov. 30, 2012, www.kiees.or.kr, vol. 22, No. 1.

Daekuen Cho et al., "A New folded Corrugated SIW with DC Biasing Capability", The Journal of Korean Institute of Electromagnetic Engineering and Science, May 2013, 24(5).

International Search Report dated Mar. 27, 2014, issued to the corresponding International Application No. PCT/KR2013/010972.

* cited by examiner

FOLDED CORRUGATED SUBSTRATE INTEGRATED WAVEGUIDE

CROSS-REFERENCE TO RELATED APPLICATIONS

This application is a national stage of International Application No. PCT/KR2013/010972, filed Nov. 29, 2013, which claims the benefit of priority to Korean Application No. 10-2013-0031457, filed Mar. 25, 2013, in the Korean Intellectual Property Office, the disclosures of which are incorporated herein by reference.

TECHNICAL FIELD

The present invention relates to a folded corrugated substrate integrated waveguide, and more particularly, to a folded corrugated substrate integrated waveguide capable of being direct current (DC) biased.

BACKGROUND ART

Substrate integrated waveguides are easily manufactured and have a low insertion loss. Also, due to a high quality factor thereof, substrate integrated waveguides have been selected as an electromagnetic wave transmission method appropriate for millimeter wave circuits.

Substrate integrated waveguides are pseudospherical waveguides in which two parallel metallic via holes or via walls are periodically arranged on a general printed circuit board (PCB).

Generally, since substrate integrated waveguides include a vertical axis wall surface formed as a metallic via hole, a surface current does not flow widthwise. Accordingly, substrate integrated waveguides only have a $TE_{m0}$ mode and a basic electric wave mode is $TE_{10}$ mode. To reduce sizes of substrate integrated waveguides described above, there are disclosed a half mode substrate integrated waveguide and a folded substrate integrated waveguide. Although a lot of passive elements have been developed based a transmission cable, the development of substrate integrated waveguide-based active elements is imperceptible.

Generally, since two isolated DC conductors exist in each of transmission cables such as a microstrip and a coplanar waveguide (CPW), it is easy to integrate with active elements. However, since substrate integrated waveguides have a short circuit structure in which the entire surface of a substrate is shielded, it is impossible to DC bias. Similarly, in the case of spherical waveguides, to integrate active elements, it is necessary to use a diode mount which is a complicated mechanical structure. However, since it is expensive and complicated, it has a difficulty in being applied to substrate integrated waveguides. Accordingly, there are provided corrugated substrate integrated waveguides. Corrugated substrate integrated waveguides are formed by replacing conductive vias having the form of side electric walls of substrate integrated waveguides with $\lambda_g/4$ microstrip open stubs. This structure has $TE_{10}$ as a basic mode identical to substrate integrated waveguides. However, since a ground surface and an upper side of a substrate integrated waveguide are perfectly isolated from each other, it is possible to DC bias.

However, in each of corrugated substrate integrated waveguides, since open stubs are arranged in an E-plane direction and a cross-sectional area increases, it is difficult to be coupled with other circuits. Also, corrugated substrate integrated waveguides operate as microstrips of one wavelength, thereby basically generating a leakage mode. Accordingly, generated leakage radiation distorts signals due to coupling with an adjacent circuit and increases radiation loss.

As a cited reference, there is disclosed Korean Patent Registration No. 10-1090857 (registered in Dec. 1, 2011).

DISCLOSURE

Technical Problem

The present invention provides a folded corrugated substrate integrated waveguide in which conductive vias used in a substrate integrated waveguide are replaced with vertical open stubs, thereby supplying direct current (DC) power.

Aspects of the present invention are not limited thereto and additional aspects of the invention will be obvious to one of ordinary skill in the art from the following description.

Technical Solution

One aspect of the present invention provides a folded corrugated substrate integrated waveguide including a first conductor plate including top stubs formed lengthwise on both sides, a first dielectric substrate whose top surface is attached to a bottom surface of the first conductor substrate, a second conductor plate whose top surface is attached to a bottom surface of the first dielectric substrate, a second dielectric substrate whose top surface is attached to a bottom surface of the second conductor plate, and stub conductors disposed in two rows in parallel with a certain interval and attached to a bottom surface of the second dielectric substrate, in which the respective stub conductors of the two rows are electrically connected to the top stubs of the first conductor plate, whose locations correspond thereto, through via holes which vertically penetrate the first dielectric substrate, the second conductor plate, and the second dielectric substrate.

The folded corrugated substrate integrated waveguide may include open stubs having a length of $\lambda/4$ formed by the respective stub conductors in two rows are connected to the top stubs of the first conductor plate, whose locations correspond thereto, through the via holes.

The second conductor plate may function as a ground for the first conductor plate and the stub conductors in two rows.

A guard ring may be formed in the second conductor plate for each of the via holes, the guard ring having a greater diameter than a diameter of the each of the via holes, not to allow the via holes to be short-circuited with the second conductor plate while penetrating the second conductor plate.

The respective stub conductors in two rows may be longer than the top stubs of the first conductor plate, whose locations correspond thereto through via holes which vertically penetrate through the first dielectric substrate, the second conductor plate, and the second dielectric substrate.

The first dielectric substrate may be thicker than the second dielectric substrate.

Advantageous Effects

According to one embodiment of the present invention, in a folded corrugated substrate integrated waveguide, conductive vias used in a substrate integrated waveguide are replaced with vertical open stubs, thereby supplying direct current (DC) power.

Also, stubs in an E-plane direction of a general corrugated substrate integrated waveguide are replaced with vertical open stubs through via holes of a folded corrugated substrate integrated waveguide, thereby reducing an E-plane size of the corrugated substrate integrated waveguide.

Also, it is possible to restrain unnecessary leakage radiation generated from stubs.

MODES OF THE INVENTION

Hereinafter, exemplary embodiments of the present invention will be described in detail with reference to the attached drawings.

The embodiments of the present invention are provided to more perfectly explain the present invention to one of ordinary skill in the art. The following embodiments may be changed into various other forms, and the scope of the present invention will not be limited thereto. The embodiments are provided to allow the present disclosure to be more perfect and to fully transfer the concept of the present invention to one of ordinary skill in the art.

The terms are used herein to describe particular embodiments but will not limit the present invention. As used herein, singular expressions, unless defined otherwise in contexts, include plural expressions. It will be further understood that the terms "comprises" and/or "comprising" used herein specify the presence of stated shapes, numbers, operations, elements, and/or groups thereof, but do not preclude the presence or addition of one or more other shapes, numbers, operations, elements, and/or groups thereof. As used herein, the term "and/or" includes any and all combinations of one or more of the associated listed items.

It will be understood that although the terms "first", "second", etc. may be used herein to describe various elements, components, areas, and layers, and/or portions, these elements, components, areas, and layers, and/or portions should not be limited by these terms. The terms do not mean a particular order, top and bottom, or merits and demerits but are only used to distinguish one element, area, or portion from another. Accordingly, a first element, area, or portion which will be described below may indicate a second element, area, or portion without deviating from teachings of the present invention.

Hereinafter, the embodiments of the present invention will be described with reference to schematic drawings thereof. Throughout the drawings, for example, according to manufacturing technologies and/or tolerances, illustrated shapes may be modified. Accordingly, the embodiments of the present invention will not be understood to be being limited to certain shapes of illustrated areas but will include changes in shape occurring while being manufactured.

Figure 1:
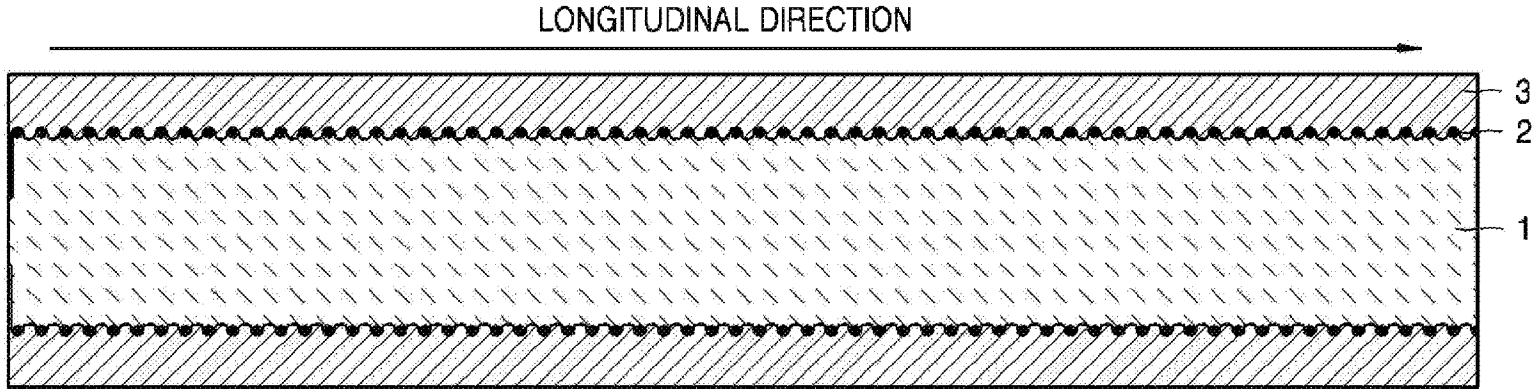
FIG. 1 is a top view of a folded corrugated substrate integrated waveguide according to one embodiment of the present invention.
Figure 2:
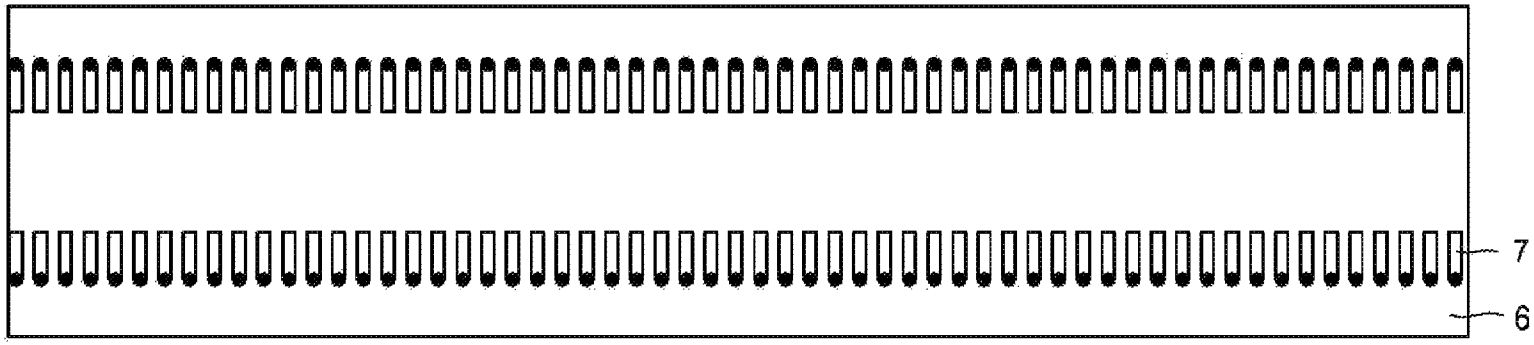
FIG. 2 is a bottom view of the folded corrugated substrate integrated waveguide according to one embodiment of the present invention.
Figure 3:
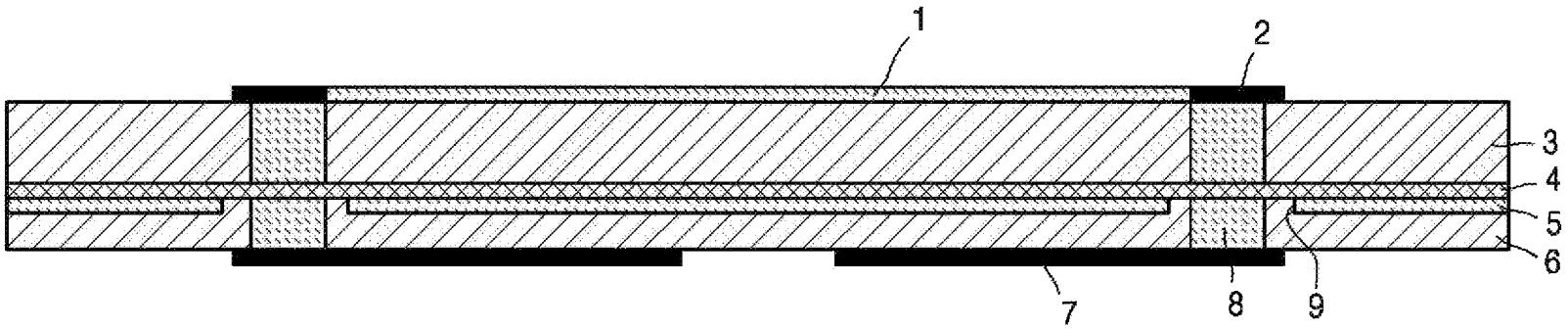
FIG. 3 is a cross-sectional view of the folded corrugated substrate integrated waveguide according to one embodiment of the present invention.

FIG. 1 is a top view of a folded corrugated substrate integrated waveguide according to one embodiment of the present invention. FIG. 2 is a bottom view of the folded corrugated substrate integrated waveguide according to one embodiment of the present invention. FIG. 3 is a cross-sectional view of the folded corrugated substrate integrated waveguide according to one embodiment of the present invention.

Referring to FIGS. 1 to 3, the folded corrugated substrate integrated waveguide according to one embodiment of the present invention includes a first conductor plate 1 which includes top stubs 2 formed lengthwise on both sides thereof, a first dielectric substrate 3 whose top surface is attached to a bottom surface of the first conductor plate 1, a second conductor plate 5 whose top surface is attached to a bottom surface of the first dielectric substrate 3, a second dielectric substrate 6 whose top surface is attached to a bottom surface of the second conductor plate 5, stub conductors 7 disposed in two rows in parallel with a certain interval and attached to a bottom surface of the second dielectric substrate 6. Here, the top surface of the second conductor plate 5 and the bottom surface of the first dielectric substrate 3 may be attached to each other by a bonding sheet 4.

The respective stub conductors 7 of the two rows may be electrically connected to the top stubs 2 of the first conductor plate 1, whose locations correspond thereto, through via holes 8 which vertically penetrate through the first dielectric substrate 3, the second conductor plate 5, and the second dielectric substrate 6. Accordingly, different from a general corrugated substrate integrated waveguide, in the folded corrugated substrate integrated waveguide according to one embodiment of the present invention, open stubs are provided as folded corrugated stubs formed by electrically connecting the top stubs 2 of the first conductor plate 1 with the stub conductors 7 in two rows through the via holes 8 instead of an E-plane direction. That is, the respective stub conductors 7 in two rows are connected with the corresponding top stubs 2 of the first conductor plate 1 to form the open stubs having a length of about $\lambda/4$, thereby reducing a size in the E-plane direction than the general corrugated substrate integrated waveguide.

The second conductor plate 5 functions as a ground with respect to the first conductor plate 1 and the stub conductors 7 in two rows.

Also, the second conductor plate 5 includes guard rings 9 having a greater diameter than a diameter of the via hole 8 for the respective via holes 8 not to allow the via hole 8 to be short-circuited with the second conductor plate 5 while the via hole 8 is penetrating through the second conductor plate 5.

The respective stub conductors 7 of the two rows may be longer than the top stubs 2 of the first conductor plate 1, which are electrically connected thereto through via holes 8 which vertically penetrate through the first dielectric substrate 3, the second conductor plate 5, and the second dielectric substrate 6.

The first dielectric substrate 3 may be thicker than the second dielectric substrate 6. Since a thickness of the first dielectric substrate 3 has an effect on integration properties of a substrate integrated waveguide, that is, an insertion loss and quality factor, a thick substrate is used for a device which is applicable to an antenna and has low loss properties. For example, when the second dielectric substrate 6 is about 0.254 mm, the first dielectric substrate 3 may be about 0.787 mm. Meanwhile, the second dielectric substrate 6 uses a thin substrate to reduce unnecessary radiation of folded corrugated stubs. That is, the second dielectric substrate 6 may use a thinner substrate than the first dielectric substrate 3. This is because an amount of radiated power may be reduced as a thickness of a dielectric is small.

A folded corrugated substrate integrated waveguide has been designed and manufactured according to one embodiment. Hereafter, a result of measuring performance thereof will be described.

For this, a length a of the first conductor plate 1 was 15 mm, a length S1 of the top stubs 2 was 0.6 mm, a diameter S2 of the via hole 8 was 1.079 mm, a length S3 of the stub conductors 7 was 3.5 mm, a thickness H1 of the first dielectric substrate 3 was 0.787, and a thickness H2 of the second dielectric substrate 6 was 0.254.

The design of a folded corrugated stub will be described.

Figure 4:
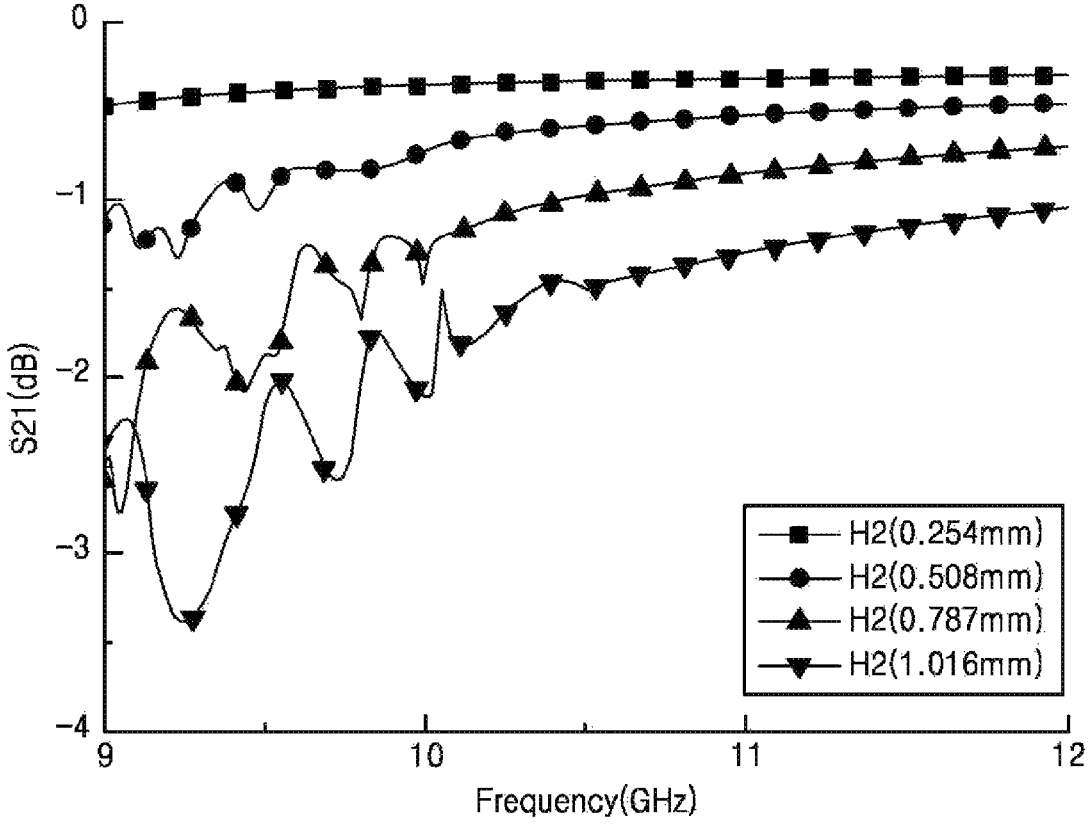
FIG. 4 is a graph illustrating an insertion loss analyzing result with respect to a change in a thickness of a second dielectric substrate.

The folded corrugated stub is designed to be a stub having a $\lambda_g/4$ length of an operation frequency of 10 GHz. For this, three design elements are needed. The design elements are a length of the stub, an interval between stubs, and a width of the stub. The length of the stub may be obtained by adding the length of the top stubs 2, the length of the stub conductors 7, and the height of the via hole 8. The via hole 8 changes in an electric length due to thicknesses of two dielectric substrates. Accordingly, a first design of the folded corrugated stub is a selection of the thickness of a dielectric substrate. Generally, a use of a substrate integrated waveguide varies according to a height thereof. A height of a substrate has an effect on integration, loss, and power capacity of a device and a system of the substrate integrated waveguide. Accordingly, in a structure of the folded corrugated substrate integrated waveguide, a thickness may vary according to uses thereof. Actually, it will be achieved by allowing two dielectric substrates to have different thicknesses. For example, since the first dielectric substrate 3 has an effect on integration properties of the substrate integrated waveguide, a thicker substrate than the second dielectric substrate 6 may be used to provide a device which is applicable to an antenna and has low loss properties. The second dielectric substrate 6 may use a thinner substrate than the first dielectric substrate 1 to reduce unnecessary radiation of the folded corrugated stub. FIG. 4 is a graph illustrating an insertion loss analyzing result with respect to a change in the thickness of the second dielectric substrate 6.

Referring to FIG. 4, since a microstrip stub of the second dielectric substrate 6 may more reduced an amount of radiated power as a thickness of a dielectric becomes smaller, an insertion loss may be reduced. As a result of analyzing using the sum of the thicknesses of the two dielectric substrates through an HFSS v. 13, that is, a 3D model simulation tool, the electric length of the via hole 8 is 21.16°.

The length of the top stubs 2 of the first conductor plate 1 and the length of the stub conductors 7 may be obtained using Equation 1 as follows.

Equation (1)

$$L = \frac{\lambda_g}{4} = \frac{c}{4f_0\sqrt{\varepsilon_e}},\ \varepsilon_e = \frac{\varepsilon_r + 1}{2} + \frac{\varepsilon_r - 1}{2}\frac{1}{\sqrt{1 + 12\ \mathrm{h/W}}}$$

Herein, L indicates one of the length of the top stubs 2 and the stub conductors 7. $f_0$ indicates an operation frequency, $\lambda g$ indicates a wavelength of a dielectric, $\in_e$ indicates an effective dielectric constant, c indicates the speed of light, h indicates a height of a dielectric substrate, and W indicates a width of one of the top stubs 2 and the stub conductors 7. The corrugated stub is a section which changes from a transverse electric (TE) mode into a quasi-TEM mode. That is, a thicker dielectric substrate, for example, the first dielectric substrate 3 thicker than the second dielectric substrate 6 operates as the substrate integrated waveguide. A thinner dielectric substrate, for example, the second dielectric substrate 6 thinner than the first dielectric substrate 3 only has bottom stubs, for example, the stub conductors 7 in two rows, thereby operating a microstrip in a transverse electromagnetic (TEM) mode. Accordingly, a stub is a microstrip cable route which varies according to an effective dielectric constant. Since the folded corrugated substrate integrated waveguide according to one embodiment of the present invention is formed of two dielectrics, an effective dielectric constant of the first conductor plate 1 differs from an effective dielectric constant of stubs corresponding to the stub conductors 7. The respective effective dielectric constants and electric lengths of the respective stubs may be calculated using Equation 1. An effective dielectric constant of the first conductor substrate 3 calculated using Equation 1 is 1.785, and an effective dielectric constant of the second dielectric substrate 6 is 1.898. An electric length of the first dielectric substrate 3 is 9.62°, and an electric length of the second dielectric substrate 6 is 57.88°. Accordingly, the sum of electric lengths of all sections of the folded corrugated stubs is 88.66°. This may be obtained by calculating the electric lengths using Equation 1 and being proportional to a 360° phase. Accordingly, the stub having a length of $\lambda_g/4$ of a using frequency of 10 GHz may be designed.

Figure 5:
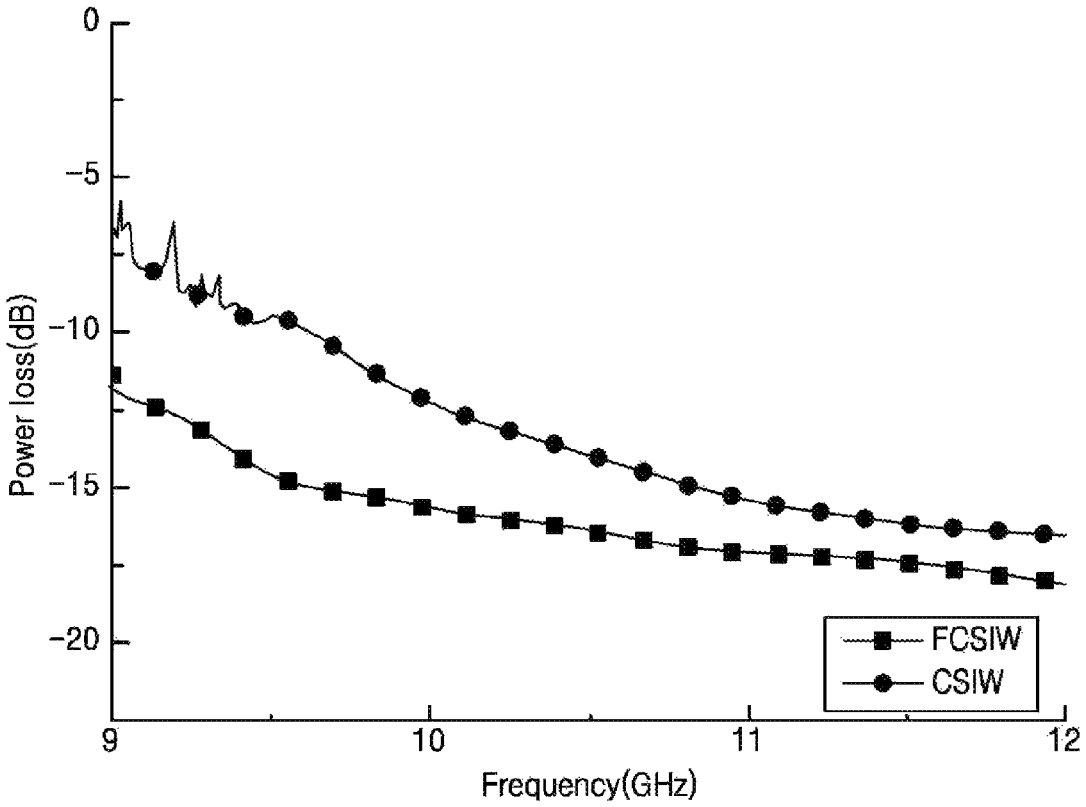
FIG. 5 is a graph illustrating an analysis result of comparing the folded corrugated substrate integrated waveguide (FCSIW) according to one embodiment of the present invention with a general corrugated substrate integrated waveguide (CSIW) in power loss.

FIG. 5 is a graph illustrating an analysis result of comparing the folded corrugated substrate integrated waveguide (FCSIW) according to one embodiment of the present invention with a general corrugated substrate integrated waveguide (CSIW) in power loss. All dielectric losses and conductor losses in substrates and metals used in analysis have been ignored. Comparing power losses in a frequency band of 9 to 12 GHz, the FCSIW shows a value of about −10 dB or less throughout the band and the general CSIW shows a high power loss due to a radiation loss.

Figure 6A:
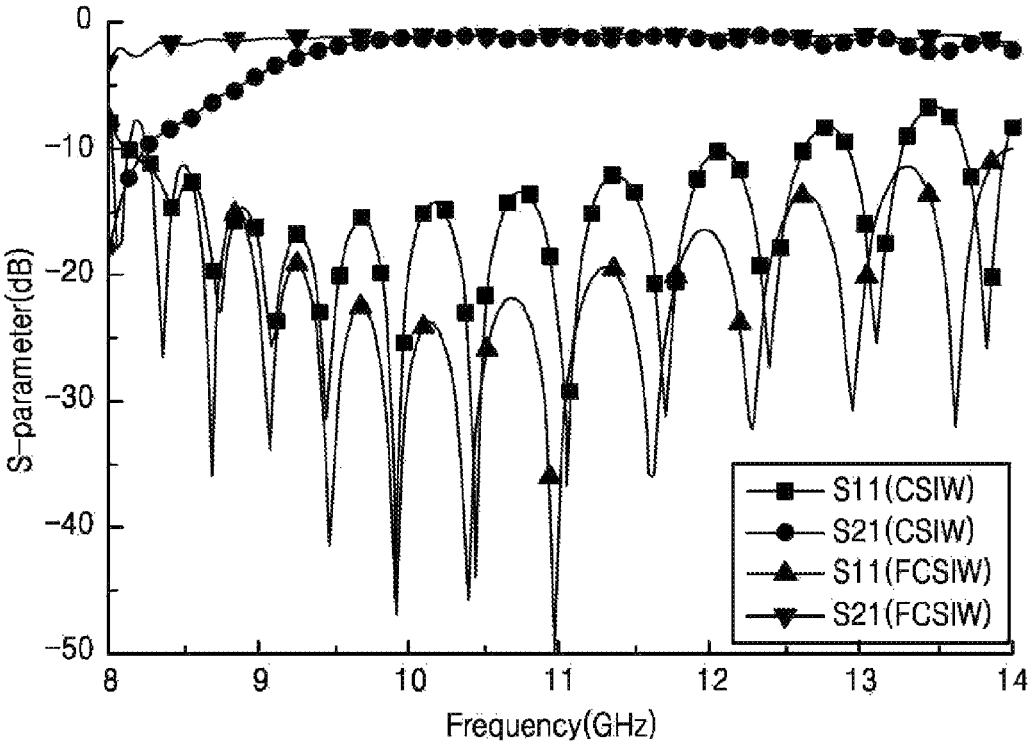
FIG. 6A is a graph of comparing analysis results of transmission properties of the FCSIW according to one embodiment of the present invention and the general CSIW.

FIG. 6A is a graph illustrating a result of comparing transmission properties of the FCSIW according to one embodiment and the general CSIW.

Both two structures were analyzed with the same length of 120 mm, except a transition structure. Although both the two structures satisfy a frequency band with a reflection loss of about 10 dB or more, since the FCSIW according to one embodiment of the present invention has more excellent matching properties than the general CSIW, the FCSIW shows matching properties of a reflection loss 20 dB or more in an available band of 10 to 13 GHz. It may be checked that a mean insertion loss of the FCSIW is 1.21 dB in the available band, which is more excellent than 2.71 dB that is a mean insertion loss of the general CSIW.

Figure 6B:
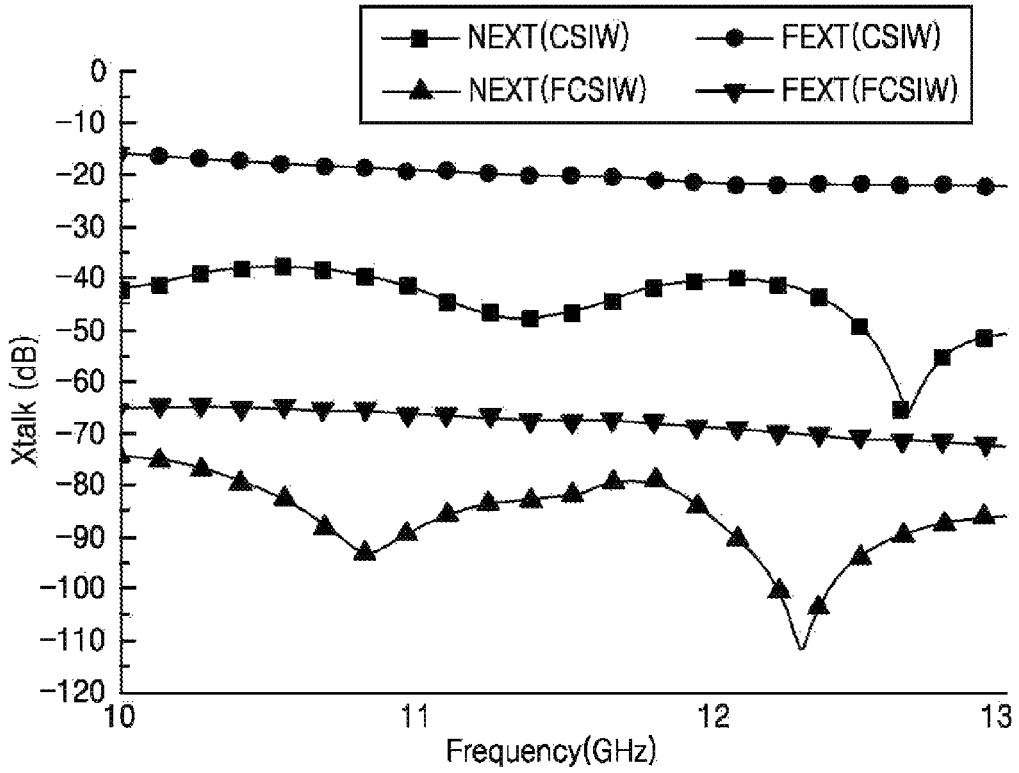
FIG. 6B is a graph illustrating a result of analyzing an interference effect by forming the FCSIW according to one embodiment of the present invention and the general CSIW as cables of the FCSIW and the CSIW in element-to-element in an interval of one wavelength of 11 GHz which is an available frequency band.

FIG. 6B is a graph illustrating a result of analyzing an interference effect when the structures of the FCSIW according to one embodiment and the general CSIW are formed as FCSIW and CSIW cable routes through element-to-element in an interval in one wavelength of 11 GHz which is an available frequency band. The FCSIW according to one embodiment may significantly improve interference properties throughout the available frequency band under a condition of the same interval of $\lambda_0$ in 11 GHz as that of the general CSIW.

Figure 7A:
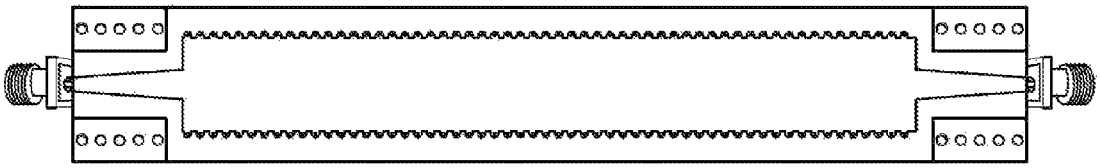
FIG. 7A is a top view of a folded corrugated substrate integrated waveguide actually manufactured according to one embodiment of the present invention.
Figure 7B:
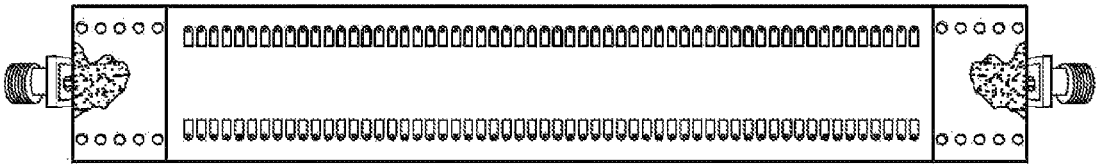
FIG. 7B is a bottom view of the folded corrugated substrate integrated waveguide actually manufactured according to one embodiment of the present invention.
Figure 7C:
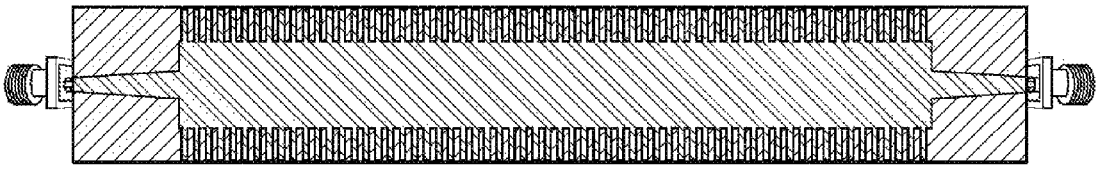
FIG. 7C (PRIOR ART)
FIG. 7C is a top view of a prior art general corrugated substrate integrated waveguide.

FIG. 7A is a top view of a folded corrugated substrate integrated waveguide actually manufactured according to one embodiment of the present invention, FIG. 7B is a bottom view of the folded corrugated substrate integrated waveguide actually manufactured according to one embodiment of the present invention, and FIG. 7C is a top view of a prior art general corrugated substrate integrated waveguide.

FIGS. 7A and 7B illustrate the folded corrugated substrate integrated waveguide manufactured according to one embodiment of the present invention. In manufacturing, a substrate of Taconic TLY-5 in which $\in_r$=2.2, a height is 0.787 mm corresponding to the height of the first dielectric substrate 3, 0.254 mm corresponding to the height of the second dielectric substrate 6, and tan $\delta$=0.0009 is used. Also, to bond the first dielectric substrate 3 to the second dielectric substrate 6, a Rogers 3001 bonding film with $\in_r$=2.55 and a height of 0.038 mm is used. A size of the manufactured folded corrugated substrate integrated waveguide is 15.65 mm×154 mm×1.079 mm (width×length×height), and a size of the manufactured corrugated substrate integrated waveguide is 25.55 mm×154 mm×0.787 mm (width×length×height).

Figure 8A:
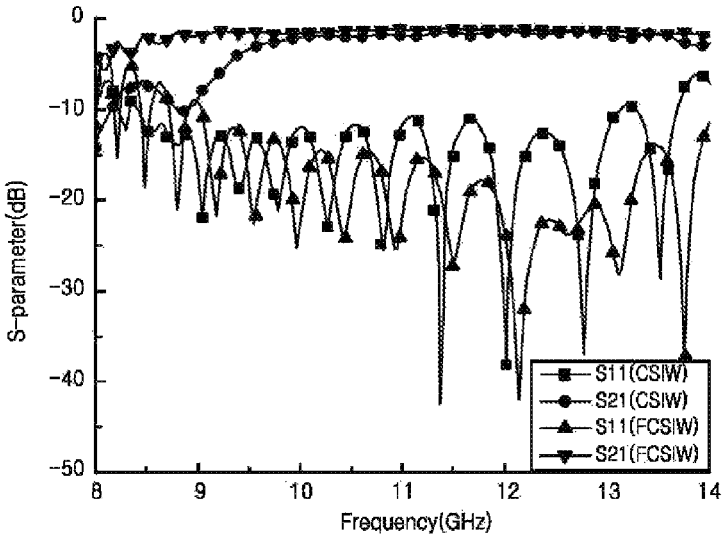
FIGS. 8A to 8C are graphs illustrating a measuring result including a microstrip FCSIW transition structure and a loss of a 2.4 mm connector.
Figure 8B:
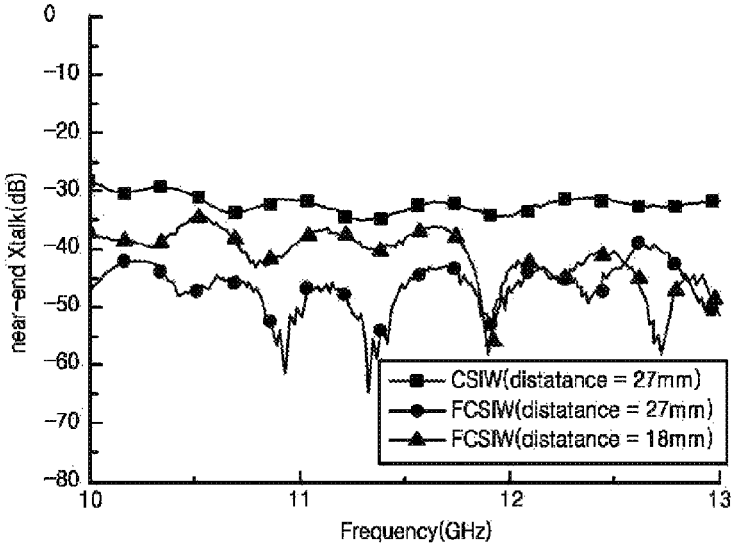
Figure 8C:
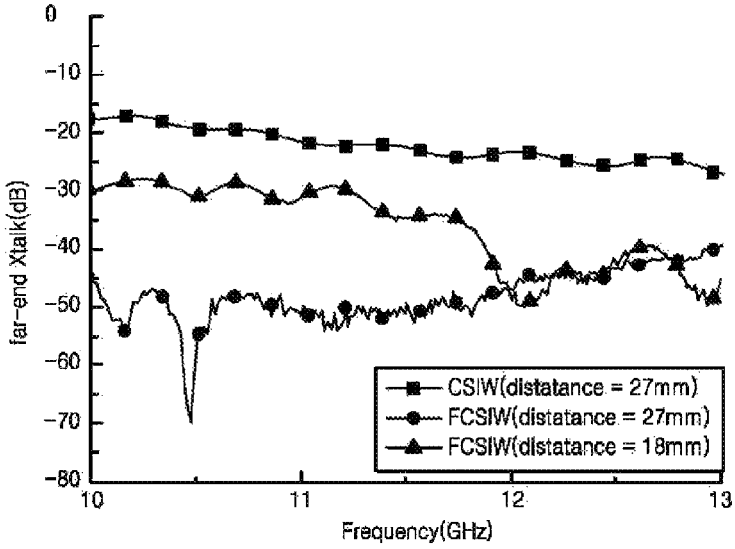

FIGS. 8A to 8C are graphs illustrating a measuring result including a microstrip FCSIW transition structure and a loss of a 2.4 mm connector. A measuring device was a vector network analyzer whose measurable level was 20 GHz.

As shown in FIG. 8A, the FCSIW has excellent matching properties of about −15 dB or less and has a mean insertion loss of 1.49 dB in an available band of 9 to 15 GHz, which is more excellent than the general CSIW with 3.08 dB.

FIGS. 8B and 8C illustrate results of measuring cross talk properties. As a result of measuring cross talk properties of the FCSIW according to one embodiment in an available band, both near-end cross talk properties and far-end cross talk properties were −40 dB that was an interval of one wavelength, which were very excellent. Also, to show the excellence of the FCSIW structure according to one embodiment of the present invention, it was measured at a minimum interval of 0.66 λ0 in which cross talk properties could be checked using a general CSIW device. As a result of measuring cross talk, near-end cross talk was −30 dB and far-end cross talk was −25 dB. As a result, it was checked that although the FCSIW according to one embodiment of the present invention was an open substrate integrated waveguide (SIW), coupling caused by leakage radiation did not occur.

While the present invention has been particularly shown and described with reference to exemplary embodiments thereof, it will be understood by those of ordinary skill in the art that various changes in form and details may be made therein without departing from the spirit and scope of the present invention as defined by the following claims. Therefore the embodiments described above would be considered in a descriptive way, not in a limitative way. Accordingly, the scope of the present invention will not be limited to the embodiments described above and it would be understood to include the content disclosed in the claims and equivalents thereof.

INDUSTRIAL APPLICABILITY

The present invention may be applied to the field of manufacturing a substrate integrated waveguide.

The invention claimed is:

1. A folded corrugated substrate integrated waveguide comprising:

a first conductor plate comprising top stubs formed lengthwise on both sides;

a first dielectric substrate whose top surface is attached to a bottom surface of the first conductor plate;

a second conductor plate whose top surface is attached to a bottom surface of the first dielectric substrate;

a second dielectric substrate whose top surface is attached to a bottom surface of the second conductor plate; and stub conductors disposed in two rows in parallel with a certain interval and attached to a bottom surface of the second dielectric substrate, wherein the respective stub conductors of the two rows are electrically connected to the top stubs of the first conductor plate, whose locations correspond thereto, through via holes which vertically penetrate the first dielectric substrate, the second conductor plate, and the second dielectric substrate, wherein the top stubs and the respective stub conductors form open circuit stubs having a length of λ/4.

2. The folded corrugated substrate integrated waveguide of claim 1, wherein the first dielectric substrate is thicker than the second dielectric substrate.

3. The folded corrugated substrate integrated waveguide of claim 1, wherein the second conductor plate functions as a ground for the first conductor plate and the stub conductors in the two rows.

4. The folded corrugated substrate integrated waveguide of claim 3, wherein a guard ring is formed in the second conductor plate for each of the via holes, the guard ring having a greater diameter than a diameter of the each of the via holes, not to allow the via holes to be short-circuited with the second conductor plate while penetrating the second conductor plate.

5. The folded corrugated substrate integrated waveguide of claim 1, wherein the respective stub conductors in the two rows are longer than the top stubs of the first conductor plate.

* * * * *